US007670204B2

(12) United States Patent
Huber

(10) Patent No.: US 7,670,204 B2
(45) Date of Patent: Mar. 2, 2010

(54) PLAYGROUND TOY

(76) Inventor: Virgil D Huber, 5601 Oak Pl., Bethesda, MD (US) 20817

( * ) Notice: Subject to any disclaimer, the term of this patent is extended or adjusted under 35 U.S.C. 154(b) by 559 days.

(21) Appl. No.: 11/299,128

(22) Filed: Dec. 9, 2005

(65) Prior Publication Data

US 2007/0135247 A1 Jun. 14, 2007

(51) Int. Cl.
*A63H 27/00* (2006.01)
*A63D 15/00* (2006.01)
*A63F 7/06* (2006.01)

(52) U.S. Cl. ..... 446/34; 273/126 R

(58) Field of Classification Search ..... 446/34; 473/423; 273/26 R, 126 R
See application file for complete search history.

(56) References Cited

U.S. PATENT DOCUMENTS 1,108,725 A 8/1914 Duncan
1,612,796 A 1/1927 Abraham
1,890,696 A * 12/1932 Rosenhahn ..... 482/90
2,269,941 A 1/1942 Jones ..... 273/126
3,883,138 A * 5/1975 Chorey ..... 473/417
4,266,781 A 5/1981 Blue ..... 273/420
4,278,254 A 7/1981 Simjian ..... 273/183 C
5,674,157 A * 10/1997 Wilkinson ..... 482/83
6,964,634 B2 * 11/2005 Wojtkiewicz et al. ..... 482/77
2004/0152568 A1 * 8/2004 Triani ..... 482/83

* cited by examiner

*Primary Examiner*—Gene Kim
*Assistant Examiner*—Michael D Dennis
(74) *Attorney, Agent, or Firm*—Baker & Daniels LLP

(57) ABSTRACT

A playground toy which is easily accessible to, and easily graspable by, a small child, a wheelchair-bound individual, or any other person with limited mobility. The playground toy generally includes a spherical-shaped ball, a ring handle, and an axle connecting the ball to the ring handle. The ring handle has a slightly different diameter than a diameter of the ball to ensure that the toy will return to the child and/or individual playing with the playground toy if, for some reason, the toy rolls away from the child and/or individual. Thus, the toy will roll away from the child and/or individual for the first half of a circular path and, if the toy continues to roll, the toy will roll towards the child and/or individual for the other half of the circular path. The ring handle provides an efficient gripping structure for picking up the ball.

10 Claims, 3 Drawing Sheets

PLAYGROUND TOY

BACKGROUND

1. Field of the Invention

The present invention relates to a playground toy and, more particularly, to a playground ball toy with a ring handle attachment.

2. Description of the Prior Art

Typical playground toys, for example, playground balls, are occasionally difficult to pick up and/or handle for small children and/or relatively immobile persons or handicapped individuals, such as those persons confined to a wheelchair. The relatively large size of the ball prevents a child from easily picking up and/or playing with the ball. Additionally, the relative size of the ball prevents a handicapped individual from easily picking up the ball while confined in a wheelchair. These persons are thus prevented from the joy of playing with these playground toys.

Moreover, when dropped, a typical playground ball may quickly roll away from the individual playing with it. Toys which roll away are burdensome to a person in a wheelchair, for example, or to an infant or small child who may not be completely mobile.

What is needed is a playground toy which is an improvement over the foregoing.

SUMMARY

The present invention provides a playground toy which is easily accessible to, and easily graspable by, a small child, a wheelchair-bound individual, or any other person with limited mobility. The playground toy generally includes a spherical-shaped ball, a ring handle, and an axle connecting the ball to the ring handle. The ring handle has a slightly different diameter than a diameter of the ball to ensure that the toy will return to the child and/or individual playing with the playground toy if, for some reason, the toy rolls away from the child and/or individual. Thus, the toy will roll away from the child and/or individual for the first half of a circular path and, if the toy continues to roll, the toy will roll towards the child and/or individual for the other half of the circular path. The ring handle provides an efficient gripping structure for picking up the ball. In one embodiment, the axle is selectively attached to the ball and/or handle.

In one form thereof, the present invention provides a playground toy including a ball; an elongate member connected to the ball; and a handle, the handle connected to the elongate member.

In another form thereof, the present invention provides a playground toy including a head portion; an elongate member connected to the head portion; and a handle, the handle connected to the elongate member.

BRIEF DESCRIPTION OF THE DRAWINGS

The above mentioned and other features and objects of this invention, and the manner of attaining them, will become more apparent and the invention itself will be better understood by reference to the following description of exemplary embodiments of the invention taken in conjunction with the accompanying drawings, wherein.

Figure 1:
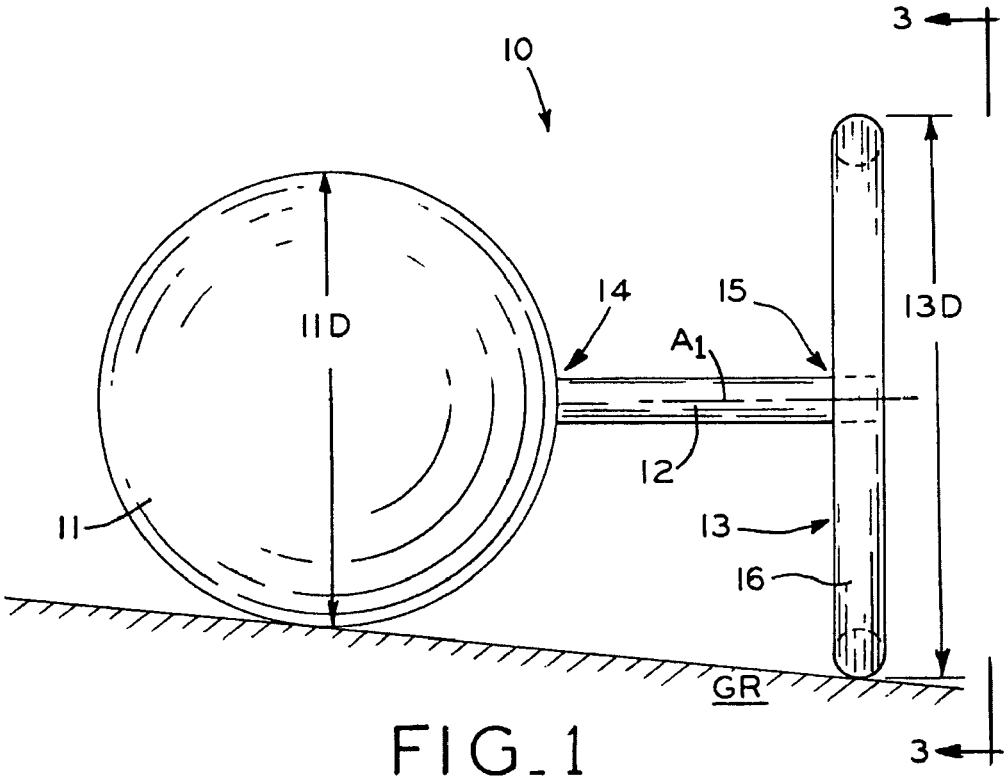
FIG. 1 is a plan view of a playground toy according to the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention, and such exemplifications are not to be construed as limiting the scope of the invention in any manner.

DETAILED DESCRIPTION

The embodiments disclosed below are not intended to be exhaustive or limit the invention to the precise forms disclosed in the following detailed description. Rather, the embodiments are chosen and described so that others skilled in the art may utilize their teachings.

The present invention provides a playground toy which is easily accessible to, and easily graspable by, a small child, a wheelchair-bound individual, or any other person with limited mobility. The playground toy generally includes a spherical-shaped ball, a ring handle, and an axle connecting the ball to the ring handle. The ring handle has a slightly larger diameter than a diameter of the ball to prevent the ball from rolling away from the child and/or individual playing with the playground toy. The ring handle provides an efficient gripping structure for picking up the ball. In one embodiment, the axle is selectively attached to the ball and/or handle.

Figure 2:
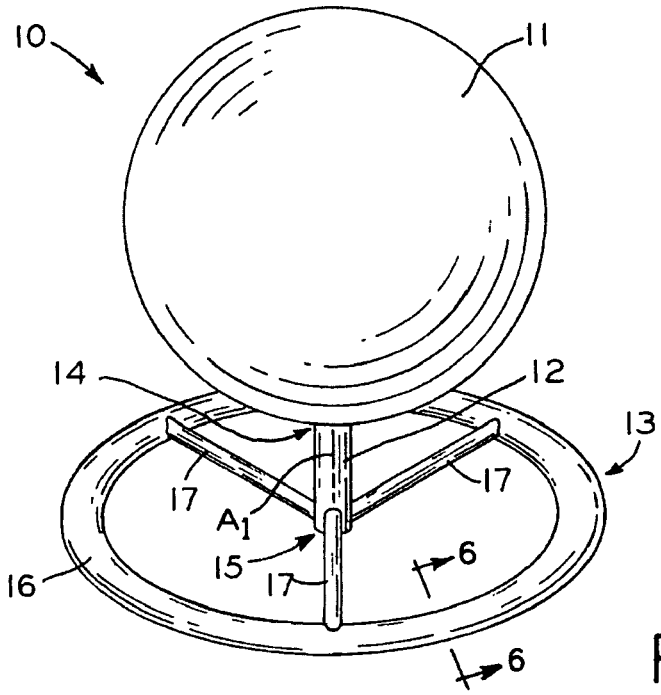
FIG. 2 is a perspective view of the playground toy of FIG. 1.
Figure 8:
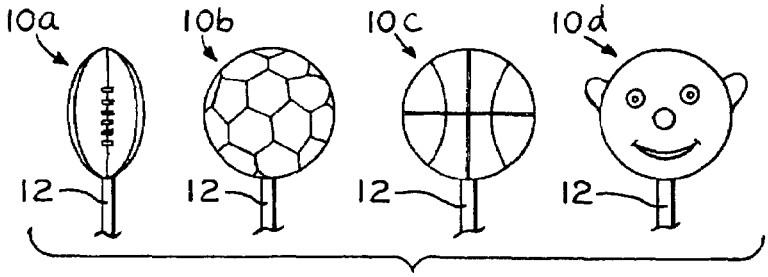
FIG. 8 is a plan view of a plurality of alternative head portions for use with the playground toy of FIG. 1.

Referring to FIGS. 1 and 2, playground toy 10 is shown and includes head portion or ball 11, elongate member or axle 12, and handle 13. Ball 11 may be constructed as a substantially spherical-shaped ball. Alternatively, ball 11 may have indentations similar to those found on a typical golf ball. Ball 11 may include roughened surfaces on its outer surface similar to a typical kickball. Ball 11 may be constructed as any other three-dimensional shaped object. For example, as shown in FIG. 8, playground toy 10*a* includes head portion 11 shaped as a typical football, playground toy 10*b* includes head portion 11 shaped as a typical soccer ball, playground toy 10*c* includes head portion 11 shaped as a typical basketball, and playground toy 10*d* includes head portion 11 shaped as a clown head. Alternatively, head portion 11 may be oval-shaped or ellipse-shaped. Head portion 11 may be shaped to resemble other toy shapes and/or any commercialized product. Alternatively, head portion 11 may be constructed as a disk or a ring similar to handle 13, described below. Head portion 11 may be constructed as a hexagonal disk, an octagonal disk, or any other polygonal shaped disk. Also, head portion 11 may be constructed as a circular disk, an elliptical disk, an oval-shaped disk, or any other shape with at least a portion having a curved circumference. Head portion 11 may also be shaped as a cone or a truncated cone constructed with similar material as described below for ball 11. The truncated cone may be constructed with paper, foam, or any other material durable enough to withstand being kicked. In yet another alternative embodiment, head portion 11 may be shaped as a bucket.

Handle 13 may be constructed as a ring-shaped structure with handle portion 16 defining the outer rim and a plurality of spokes 17 connecting handle portion 16 to elongate member 12 at connection 15. Connection 15 may include a permanent connection, a snap-fit connection, a threaded connection, or any other suitable connection to fix spokes 17 to elongate member 12. Elongate member 12 connects ball 11 and handle 13. Alternatively, handle 13 may be constructed as a flat disk. The flat disk may also include a thicker edge or rim to provide a gripping structure, e.g., similar to a Frisbee. Alternatively, handle 13 may be constructed with a large number of spokes 17 each with a wide and strong construction, such that handle portion 16 would not be necessary. For example, handle 13 may include spokes 17 similar to those found on a bicycle wheel. Alternatively, head portion 11 may include a plurality of balls, disks, or cones having varying diameters and handle 13 may also include a plurality of ring-shaped structures or disks of varying diameters, for example, two head portions 11 with different diameters arranged coaxially on elongate member 12 and two handles 13 with different diameters arranged coaxially on elongate member 12. In such a configuration, there may be a space between head portions 11 or head portions 11 may be abutted against each other and there may be a space between handles 13 or handles 13 may be abutted against each other. The varying diameters of head portions 11 and handles 13 may be chosen to ensure that playground toy 10 rolls in a circular path, as described below. Alternatively, head portion 11 may be constructed as a top hat structure with an upper-extending portion and a brim portion. The brim portion may be elliptically shaped and thus, when playground toy 10 rolls in path P, the elliptical brim may cause a non-circular or wavy rotation of head portion 11.

Ball 11 may be solid or hollow and constructed of various materials such as wood, metal, plastic, or rubber. If ball 11 is hollow, it may be at least partially filled with fluid, such as air, water, or gas, e.g., helium gas. In an exemplary embodiment, ball 11 is made of a soft, resilient material, such as leather, rubber, plastic, foam rubber, or foam, for example. Ball 11 may be made of any material that would be safe to play with and have sufficient durability.

Figure 6:
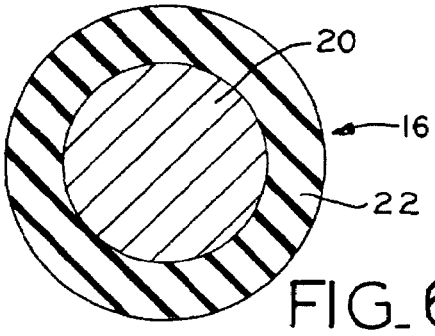
FIG. 6 is a cross-sectional view of the handle portion of the playground toy of FIG. 2, taken along line 6-6 of FIG. 2.

Elongate member 12 and handle 13 may be solid or hollow and also constructed of various materials such as wood, metal, plastic, or rubber. Handle portion 16 may include a gripping surface disposed thereon, for example, a rubberized coating, to facilitate gripping of handle 13 by a user. As shown in FIG. 6, handle portion 16 may include a two-part construction. Inner portion 20 may be a relatively solid material such as wood or metal. Outer portion 22 forms a gripping structure and may be a relatively soft, resilient material, such as leather, rubber, plastic, or foam, for example. Outer portion 22 may also include grip material similar to that used on typical tennis rackets, i.e., grip tape, or golf clubs, i.e., golf club grips. Handle portion 16 may be made of any materials which are safe to play with and have sufficient durability.

Connection 14 between elongate member 12 and ball 11 may be a permanent connection using a suitable fitting such as a plurality of screws or a glue-type substance, for example. Alternatively, elongate member 12 and ball 11 may be integrally formed together as a single-piece construction. In such a configuration, a player picks up playground toy 10 via handle portion 16 of handle 13 and may either throw or kick playground toy 10 to another player or toward a goal involved in the playground game. Also, a player may bounce playground toy 10 on ground surface GR such that elongate member 12 and handle 13 are vertically aligned directed above the center of ball 11 and therefore directly above the contact point where ball 11 contacts ground surface GR, thereby allowing the player to continue to bounce playground toy 10 directly vertically upward using handle 13.

Figure 7:
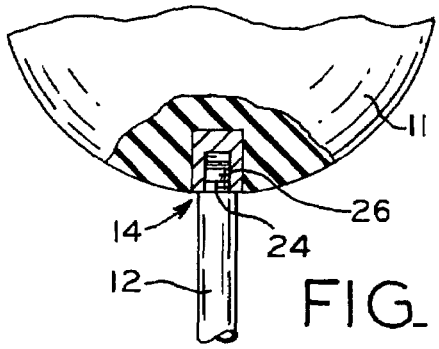
FIG. 7 is a partial cross-sectional view of a portion of the playground toy of FIG. 1, further illustrating the connection between the elongate member and the head portion.

Alternatively, connection 14 may comprise a selective connection whereby a user may remove elongate member 12 from connection with ball 11 at the user's convenience. In such a configuration, connection 14 may comprise a snap-fit engagement, a bayonet-type interface, a suction-type interface, a threaded interface, or any other suitable detachable connection. For example, shown in FIG. 7, connection 14 is a threaded connection. Elongate member 12 includes threaded end portion 24 which threadably engages threaded aperture 26 provided in ball 11. Alternatively, aperture 26 may comprise a friction-fit engagement with end portion 24 which maintains connection 14 until a sufficient force causes end portion 24 of elongate member 12 to be removed from aperture 26. In yet another alternative embodiment, aperture 26 is a bayonet-type receptacle which accepts end portion 24 of elongate member 12 and, upon rotation of elongate member 12, elongate member 12 is locked to ball 11. In still another alternative embodiment, end portion 24 of elongate member 12 may be removed from engagement with ball 11 via manual activation of a release lever or other suitable disengagement device. In a still further alternative embodiment, end portion 24 may be attached to ball 11 via a hook and loop connection, e.g., VELCRO®. A detachable connection 14 advantageously allows a user to pick up toy 10 via handle 13 and then remove ball 11 therefrom to either throw or kick ball 11 to another person or to throw or kick ball 11 toward a goal involved in the playground game. Similarly, connection 15 may comprise a selective connection whereby a user may remove handle 13 from elongate member 12 at the user's convenience. In such a configuration, connection 15 may comprise a snap-fit engagement, a bayonet-type interface, a suction-type interface, a threaded interface, or any other suitable detachable connection. A detachable connection advantageously allows a user to pick up toy 10 via handle 13 and then remove ball 11 with elongate member 12 attached thereto and proceed to play with ball 11.

Figure 3:
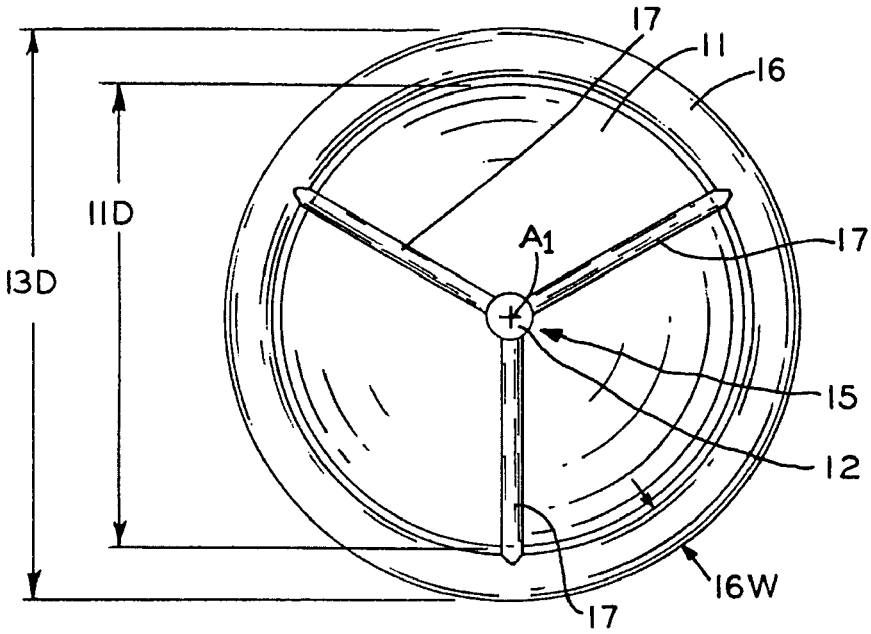
FIG. 3 is an end view of the playground toy of FIG. 1, taken along line 3-3 of FIG. 1.
Figure 4:
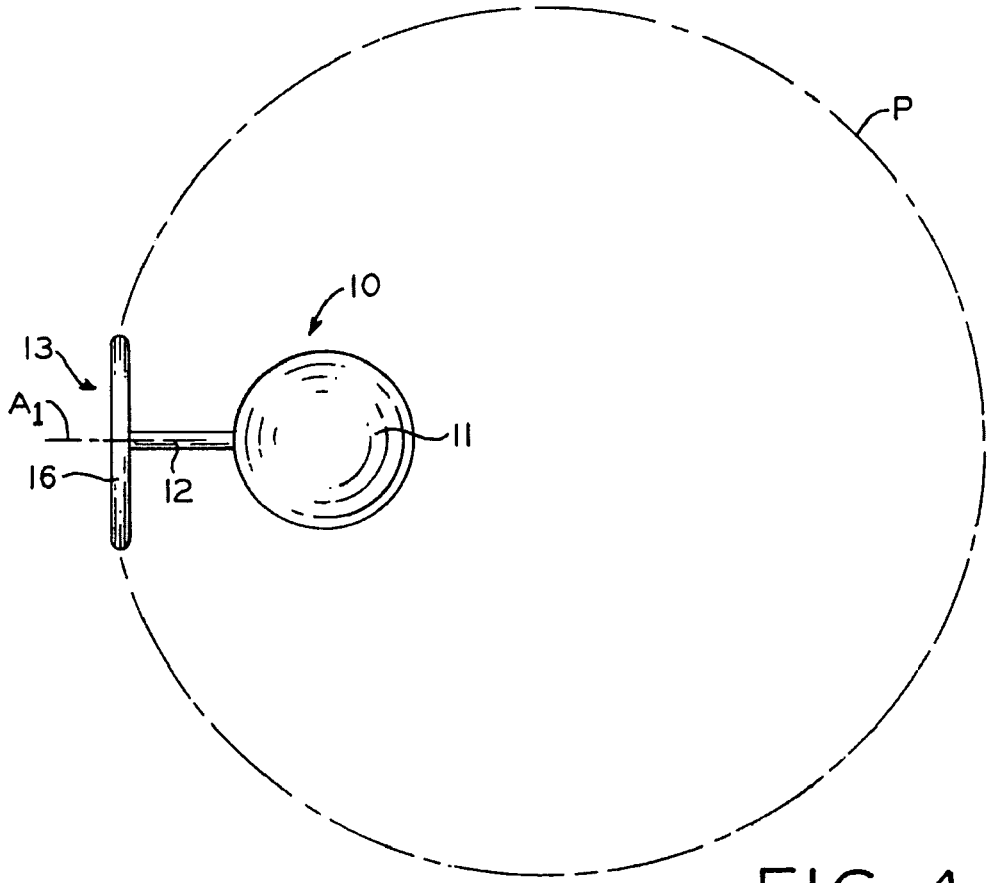
FIG. 4 is a top plan view of the motion of the playground toy of FIG. 1.

Referring now to FIGS. 1 and 3, ball diameter 11D is slightly smaller than handle diameter 13D. Such a configuration causes playground toy 10 to roll in a circular path. For example, because handle diameter 13D is larger than ball diameter 11D, when ball 11 is placed on ground surface GR, handle 13 vertically extends a greater distance than ball 11. Because of this configuration, in an exemplary embodiment, if ball 11 rolls or is accidentally pushed away from a player, playground toy 10 rolls in a circular pattern eventually returning to its original location. As shown in FIG. 4, handle 13 of playground toy 10 will basically follow path P and return very close to the original location. The offset between ball 11 and handle 13 creates stability and precision of rolling playground toy 10 in a circular path. When ball 11 moves away from a player, it may slightly skid on ground surface GR but the path of movement of playground toy 10 will still substantially follow path P.

In one embodiment, ball diameter 11D is approximately 11 inches, handle diameter 13D is approximately 12 inches, and handle portion width 16W is approximately 1 inch. Alternatively, handle diameter 13D may be any height which accommodates a wheelchair-bound individual or other person with limited mobility. Alternatively, handle diameter 13D may be less than ball diameter 11D which still ensures that playground toy 10 will eventually return to its original location by following a circular path. If elongate member 12 is chosen to be relatively short compared to diameters 11D and 13D, then handle diameter 13D may be made smaller but still remain different than ball diameter 11D. In one embodiment, elongate member 12 may be chosen to be very short in length such that ball 11 nearly touches handle 13. In another embodiment, ball diameter 11D may be chosen to be the size of a typical softball, basketball, beach ball, or other diameters, for example, approximately three feet.

Figure 5:
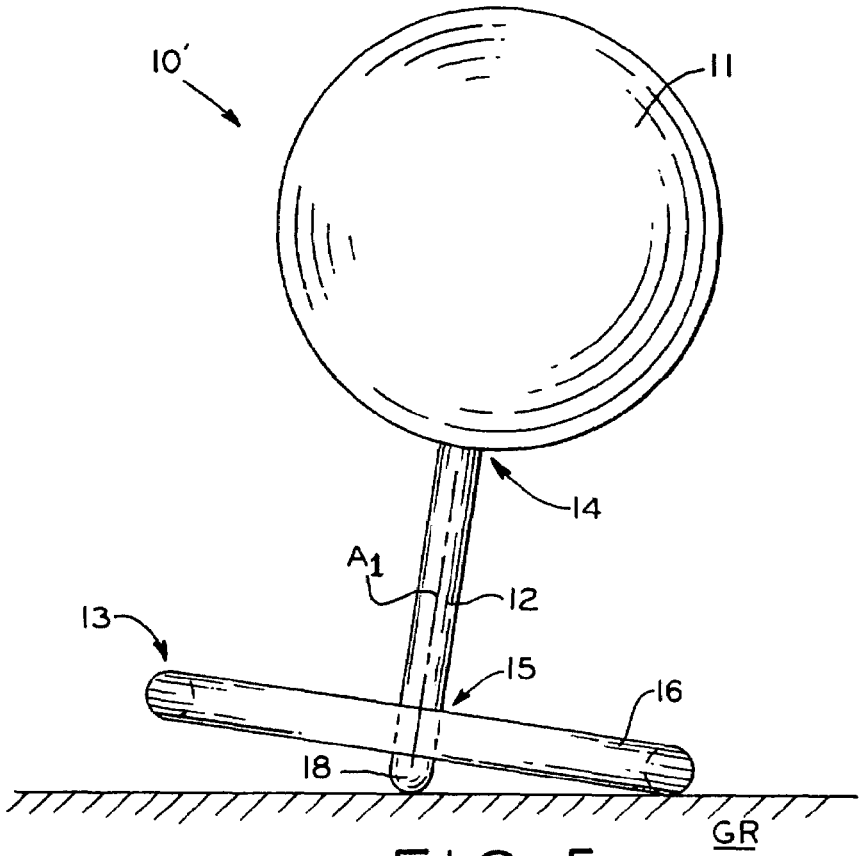
FIG. 5 is a side plan view of an alternative playground toy.

As shown in FIG. 5, an alternative embodiment playground toy 10' is shown which, except as described below, is substantially similar in structure and operation to playground toy 10 (FIGS. 1-4) described above. Playground toy 10' includes extension 18 which may be an extension of axle 12 or may be an additional piece attached near connection 15. Extension 18 adds an advantageous feature to playground toy 10'. If handle 13 is horizontal to ground surface GR, as shown in FIG. 1, a person of limited mobility may have difficulty reaching and grasping handle 13. Extension 18 advantageously lifts a portion of handle 13 above ground surface GR to provide efficient access to a person of limited mobility. If a person still cannot reach handle 13 even when a portion thereof is lifted above ground surface GR, extension 18 advantageously provides an initial angle of playground toy 10 which permits a person to push playground toy 10 to a position where handle 13 is substantially vertical and can more readily be picked up.

In one embodiment, playground toy 10 may include ball 11 designed as a globe with elongate member 12 attached between the equator and the north pole of the globe. The diameter of handle 13 may be different than the diameter of ball 11 so that playground toy 10 may roll in a circular path. Alternatively, playground toy 10 may include ball 11 designed as a globe with a disk handle 13 or ring 16 attached between the equator and the north pole of the globe. In yet another alternative embodiment, elongate member 12 may extend through ball 11 and playground toy 10 may include handle 13 on either or both opposing ends of elongate member 12. In such a configuration, handle 13 may have varying diameters with respect to each other and with respect to ball 11.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A toy, comprising;

a ball having a substantially spherical shape;

a handle having a substantially annular shape and a central longitudinal axis;

an elongate member formed as a rod, said elongate member oriented along said central longitudinal axis of said handle, said elongate member having a first end and a second end, said first end directly connected to said ball;

a plurality of spokes each having a first end and a second end, said first ends of said plurality of spokes connected to said handle, and said second ends of said plurality of spokes connected to said elongate member, said plurality of spokes together forming the sole connection between said elongate member and said handle; and an extension member, said extension member connected to said second end of said elongate member, wherein said extension member protrudes beyond a plane formed by said handle and includes an end defining the furthest extent of said toy along said central longitudinal axis in a direction opposite said ball, whereby when said extension member is in contact with a flat surface, a first portion of said handle is in contact with the flat surface, and a second portion of said handle, disposed opposite said first portion of said handle, is elevated above the flat surface.

2. The toy of claim 1, wherein said elongate member extends beyond said plane formed by said handle and said plurality of spokes, whereby when said elongate member is in contact with a flat surface, a first portion of said handle is in contact with the flat surface, and a second portion of said handle, disposed opposite said first portion of said handle, is elevated above the flat surface.

3. The toy of claim 1, wherein said elongate member is rigid.

4. The toy of claim 1, wherein said ball has a first diameter and said handle has a second diameter greater than said first diameter.

5. The toy of claim 1, wherein said elongate member is removably connectable to said ball.

6. The toy of claim 1, wherein said ball includes a first screw thread and said elongate member includes a second screw thread.

7. The toy of claim 1, wherein said handle has a circular cross section, and is formed of a relatively rigid inner portion and a relatively soft outer portion.

8. The toy of claim 1, wherein said ball is football-shaped, including a major dimension and minor dimension, said elongate member disposed parallel to said major dimension.

9. The toy of claim 1, wherein said plurality of spokes are formed as rods extending between said elongate member and said handle.

10. The toy of claim 1, wherein said plurality of spokes directly and rigidly connect said elongate member and said handle.

* * * * *